US008939615B2

(12) United States Patent
Rong et al.

(10) Patent No.: US 8,939,615 B2
(45) Date of Patent: Jan. 27, 2015

(54) OPTICALLY EFFICIENT NOTIFICATION DEVICE FOR USE IN LIFE SAFETY WALL STROBE APPLICATIONS

(71) Applicant: Cooper Technologies Company, Houston, TX (US)

(72) Inventors: Wei Rong, Midland, MI (US); Joseph Kosich, South Toms River, NJ (US); Crystal Pierz, Hazlet, NJ (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/953,471

(22) Filed: Jul. 29, 2013

(65) Prior Publication Data

US 2013/0308322 A1 Nov. 21, 2013

Related U.S. Application Data

(63) Continuation of application No. 13/372,730, filed on Feb. 14, 2012, now Pat. No. 8,496,363, which is a continuation of application No. 12/558,886, filed on Sep. 14, 2009, now Pat. No. 8,113,694.

(51) Int. Cl.

| | |
|---|---|
| ***F21V 7/00*** | (2006.01) |
| ***F21S 8/00*** | (2006.01) |
| ***F21V 13/02*** | (2006.01) |
| ***F21V 7/09*** | (2006.01) |

(Continued)

(52) U.S. Cl.

CPC ... *F21V 7/09* (2013.01); *G08B 5/38* (2013.01); *G09F 13/14* (2013.01)

USPC ..... 362/349; 362/147; 362/343; 362/516; 362/346; 362/297

(58) Field of Classification Search

CPC ..... F21V 21/02; F21S 8/033

USPC ..... 362/147, 343, 516, 346, 297, 349

See application file for complete search history.

(56) References Cited

U.S. PATENT DOCUMENTS

| | | | |
|---|---|---|---|
| 2,905,863 | A | 9/1959 | Martin et al. |
| 4,837,559 | A | 6/1989 | Green |
| 4,954,938 | A | 9/1990 | Lyons |

(Continued)

OTHER PUBLICATIONS

International Search Report and Written Opinion for PCT/US2010/048368 issued Nov. 2, 2010.

(Continued)

*Primary Examiner* — Jong-Suk (James) Lee
*Assistant Examiner* — Bryon T Gyllstrom
(74) *Attorney, Agent, or Firm* — King & Spalding LLP

(57) ABSTRACT

A wall notification device described herein can draw a lower current by providing a more efficient reflector configuration. The reflector is designed to be positioned on a wall and provide sufficient light output in each of the requisite directions, as required by the UL 1971 standard. The notification device has a reflector unit having a base having a curved portion centered on the vertical axis and a flat portion extending from the curved portion; a reflective flange extending from a location near a top side of the base; a first and second specular protrusion extending from the curved portion of the base; a third and fourth specular protrusion extending from the base; a fifth and sixth specular protrusion extending from the curved portion of the base; and a sixth and seventh specular protrusion extending form the flat portion of the base.

20 Claims, 7 Drawing Sheets

(51) Int. Cl.
*G08B 5/38* (2006.01)
*G09F 13/14* (2006.01)

(56) References Cited

U.S. PATENT DOCUMENTS

| | | | | |
|---|---|---|---|---|
| 5,249,110 | A * | 9/1993 | Russello et al. | 362/294 |
| 5,347,259 | A | 9/1994 | Jongewaard | |
| 5,448,462 | A | 9/1995 | Moran, III | |
| 5,475,361 | A | 12/1995 | Curran et al. | |
| 5,546,293 | A | 8/1996 | Moran, III | |
| 5,622,427 | A * | 4/1997 | Lemons et al. | 362/300 |
| 5,684,467 | A | 11/1997 | Hur | |
| 5,865,527 | A * | 2/1999 | Lemons et al. | 362/298 |
| 5,931,569 | A * | 8/1999 | Anderson | 362/346 |
| D424,465 | S | 5/2000 | Davidson | |
| 6,057,778 | A | 5/2000 | Davidson | |
| 6,158,869 | A | 12/2000 | Barnes | |
| 6,217,196 | B1 | 4/2001 | Kosich et al. | |
| 6,508,574 | B1 * | 1/2003 | Sara et al. | 362/297 |
| 6,623,143 | B2 | 9/2003 | Anderson | |
| 6,793,375 | B2 * | 9/2004 | Anderson | 362/304 |
| 6,838,997 | B1 | 1/2005 | Davidson | |
| 7,006,003 | B2 * | 2/2006 | Zimmerman et al. | 340/815.4 |
| 7,128,446 | B2 | 10/2006 | Vanden Eynden | |
| 7,183,483 | B1 | 2/2007 | Anderson et al. | |
| 7,261,440 | B2 | 8/2007 | Kwasny | |
| RE39,900 | E * | 10/2007 | Hein et al. | 362/308 |
| 8,113,694 | B2 | 2/2012 | Rong | |
| 8,496,363 | B2 | 7/2013 | Rong | |
| 2002/0018344 | A1 * | 2/2002 | Sears et al. | 362/265 |
| 2002/0085374 | A1 * | 7/2002 | Anderson | 362/147 |
| 2003/0086269 | A1 * | 5/2003 | Anderson | 362/304 |
| 2004/0056773 | A1 * | 3/2004 | Zimmerman et al. | 340/815.4 |
| 2005/0128748 | A1 | 6/2005 | Suwa | |
| 2006/0028328 | A1 | 2/2006 | Cresse | |
| 2006/0203493 | A1 | 9/2006 | Brower et al. | |

OTHER PUBLICATIONS

International Search Report and Written Opinion for PCT/US2010/048401 issued Nov. 3, 2010.

* cited by examiner

OPTICALLY EFFICIENT NOTIFICATION DEVICE FOR USE IN LIFE SAFETY WALL STROBE APPLICATIONS

RELATED APPLICATION

This application is a continuation of and claims priority under 35 U.S.C. §120 to U.S. patent application Ser. No. 13/372,730, titled "Optically Efficient Notification Device for Use in Life Safety Wall Strobe Applications," filed Feb. 14, 2012, which is a continuation of and claims priority under 35 U.S.C. §120 to U.S. patent application Ser. No. 12/558,886, titled "Optically Efficient Notification Device for Use in Life Safety Wall Strobe Applications," filed on Sep. 14, 2009, now U.S. Pat. No. 8,113,694, the entire contents of which are hereby incorporated herein by reference.

TECHNICAL FIELD

The present application relates generally to a notification device for use in life safety wall strobe applications.

BACKGROUND

Life safety systems include notification devices positioned on walls and ceilings, as required by law. These notification devices can include a horn for an audible alert and/or a strobe for a visual alert. Notification devices draw energy to illuminate a strobe in a life safety application, such as a fire alarm or other signaling device. A notification device can be mounted on a surface, e.g., a wall or a ceiling, and aimed at the floor. The notification device has a reflector with internal reflecting surfaces to reflect light toward the specified space. The reflector can also have some external secondary reflector elements mounted on the reflector body.

Notification devices for the hearing impaired are governed by standards that require a polar light distribution off-axis at any given rated candela. In order to achieve the standard, the notification device must produce a minimum output at specified angles off-axis. For example, for a notification device to be rated at 185 candela, UL 1971 requires that the strobe has specific light intensities at viewing angles ranging from zero to 90 degrees off axis. UL 1971 requires a polar light distribution pattern to enhance the likelihood of alerting hearing impaired individuals throughout an area. The light intensity is measured in a horizontal and vertical direction and at viewing angles ranging from zero to +90 degrees and zero to −90 degrees. In one example, the UL polar distribution requires a percentage of the candela output at specific angles off-axis, e.g., five degrees off-axis requires an output of 90% of the rated on-axis value. So a 15 candela strobe is required to output 13.5 candela at five degrees off-axis.

It is desirable to use less energy, but the light output of the strobe must meet the requisite standards to achieve underwriting. As a result, the amount of energy is limited by the minimum required light output. The amount of current drawn by the notification device can be affected by various aspects of its configuration, including reflector design, electrical efficiency, lamp efficiency, efficiency of a metalized coating used for high reflectance, and the efficiency of the lens. It is desirable to adjust the properties of the notification device so that less current is needed to power the notification device while maintaining a required amount of light output.

SUMMARY

A notification device described herein can draw a lower current by providing a more efficient reflector configuration.

The optically efficient reflector is generally a rectangular reflector being symmetrical about a central axis. The reflector is designed to be positioned on a wall and provide sufficient light output in each of the requisite directions, as required by the UL 1971 standard. For example, a notification device described herein can provide a 185 candela output using a 2.5 J flashtube lamp.

In one embodiment, a notification device comprises a housing configured to be installed on a wall; a reflector unit mounted to the housing and symmetrical about a vertical axis, the reflector unit comprising a base having a curved portion centered on the vertical axis and a flat portion extending from the curved portion on a first side of the vertical axis and a second side of the vertical axis; a reflective flange extending from a location near a top side of the base and along a plane perpendicular to the wall, the reflective flange having a lower surface that tapers from the vertical axis toward the top side of the base; a first specular protrusion and a second specular protrusion extending from the curved portion of the base, wherein the first specular protrusion is positioned on the first side of the vertical axis and the second specular protrusion is positioned on the second side of the vertical axis, the first specular protrusion and the second specular protrusion each comprising a surface substantially directed toward a lower edge of the base near the vertical axis; a third specular protrusion and a fourth specular protrusion extending from the base, wherein the third specular protrusion is positioned on the first side of the vertical axis and the fourth specular protrusion is positioned on the second side of the vertical axis, the third specular protrusion and the fourth specular protrusion each extending from a lower edge of the base and tapering in a direction parallel to the vertical axis; a fifth specular protrusion and a sixth specular protrusion extending from the curved portion of the base, wherein the fifth specular protrusion is positioned on the first side of the vertical axis and the sixth specular protrusion is positioned on the second side of the vertical axis, and wherein the fifth specular protrusion is proximate to the third specular protrusion on a side of the third specular protrusion nearest the vertical axis and the sixth specular protrusion is proximate to the fourth specular protrusion on a side of the fourth specular protrusion nearest the vertical axis, the fifth specular protrusion and the sixth specular protrusion each having a curved surface substantially directed toward a central point of the curved portion of the base; and a sixth specular protrusion and a seventh specular protrusion extending form the flat portion of the base, wherein the sixth specular protrusion is positioned on the first side of the vertical axis and the seventh specular protrusion is positioned on the second side of the vertical axis, and wherein the sixth specular protrusion and the seventh specular protrusion each taper toward the vertical axis; a lens coupled to the housing and positioned over the reflector unit; and a lamp positioned in the center of the curved portion of the base.

In another embodiment, a reflector unit configured for a notification device on a wall comprises a base having a curved portion centered on the vertical axis and a flat portion extending from the curved portion on a first side of the vertical axis and a second side of the vertical axis; a reflective flange extending from a location near a top side of the base and along a plane perpendicular to the wall, the reflective flange having a lower surface that tapers from the vertical axis toward the top side of the base; a first specular protrusion and a second specular protrusion extending from the curved portion of the base, wherein the first specular protrusion is positioned on the first side of the vertical axis and the second specular protrusion is positioned on the second side of the vertical axis, the first specular protrusion and the second specular protrusion each comprising a surface substantially directed toward a lower edge of the base near the vertical axis; a third specular protrusion and a fourth specular protrusion extending from the base, wherein the third specular protrusion is positioned on the first side of the vertical axis and the fourth specular protrusion is positioned on the second side of the vertical axis, the third specular protrusion and the fourth specular protrusion each extending from a lower edge of the base and tapering in a direction parallel to the vertical axis; a fifth specular protrusion and a sixth specular protrusion extending from the curved portion of the base, wherein the fifth specular protrusion is positioned on the first side of the vertical axis and the sixth specular protrusion is positioned on the second side of the vertical axis, and wherein the fifth specular protrusion is proximate to the third specular protrusion on a side of the third specular protrusion nearest the vertical axis and the sixth specular protrusion is proximate to the fourth specular protrusion on a side of the fourth specular protrusion nearest the vertical axis, the fifth specular protrusion and the sixth specular protrusion each having a curved surface substantially directed toward a central point of the curved portion of the base; and a sixth specular protrusion and a seventh specular protrusion extending form the flat portion of the base, wherein the sixth specular protrusion is positioned on the first side of the vertical axis and the seventh specular protrusion is positioned on the second side of the vertical axis, and wherein the sixth specular protrusion and the seventh specular protrusion each taper toward the vertical axis.

These and other aspects, objects, and features of the invention will become apparent to those having ordinary skill in the art upon consideration of the following detailed description of exemplary embodiments exemplifying the best mode for carrying out the invention as presently perceived.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION

Figure 1B:
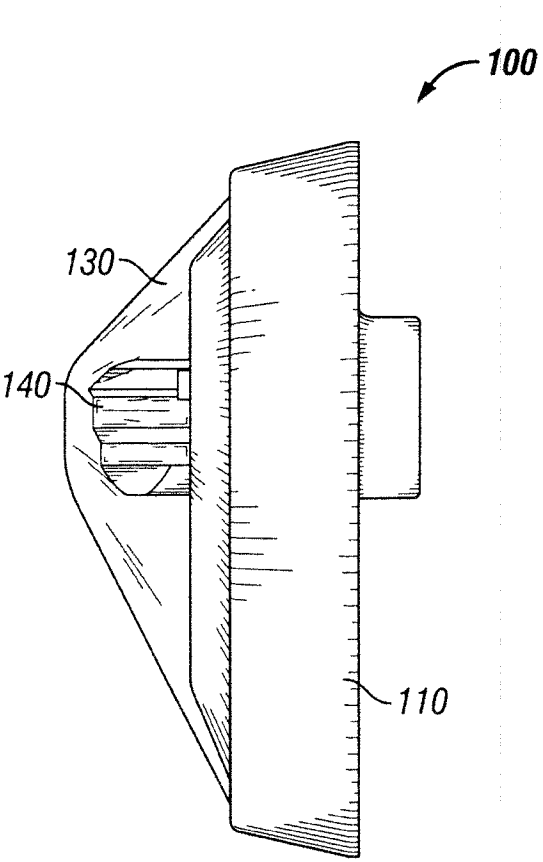
FIG. 1*b* is a side view of a notification device according to an exemplary embodiment.
Figure 1A:
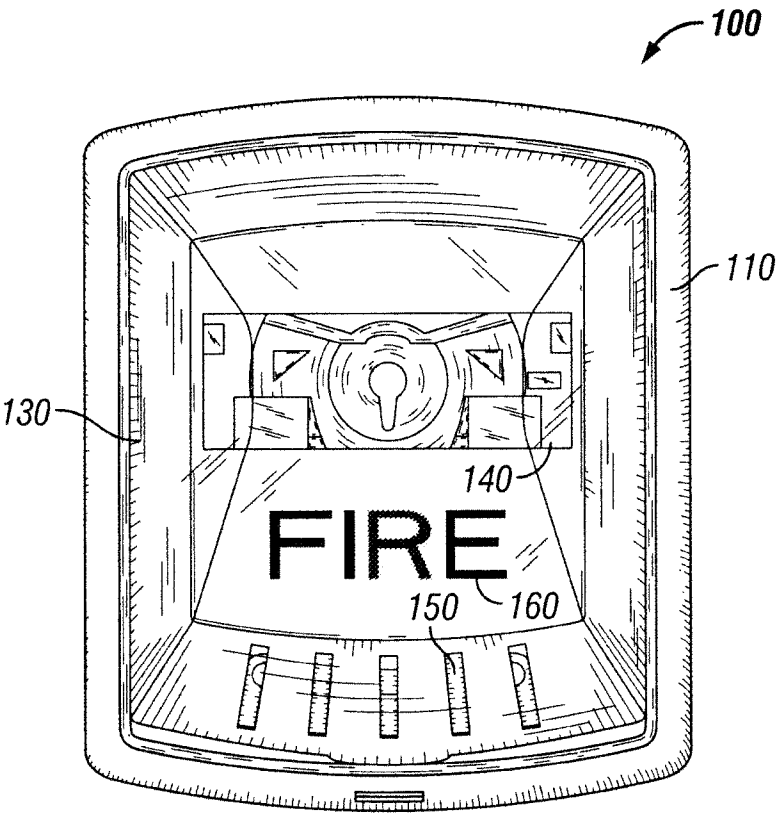
FIG. 1*a* is a frontal view of a notification device according to an exemplary embodiment.
Figure 1C:
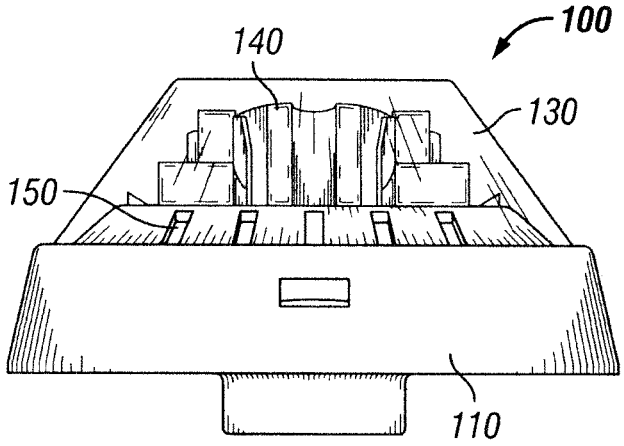
FIG. 1*c* is a bottom view of a notification device according to an exemplary embodiment.
Figure 1D:
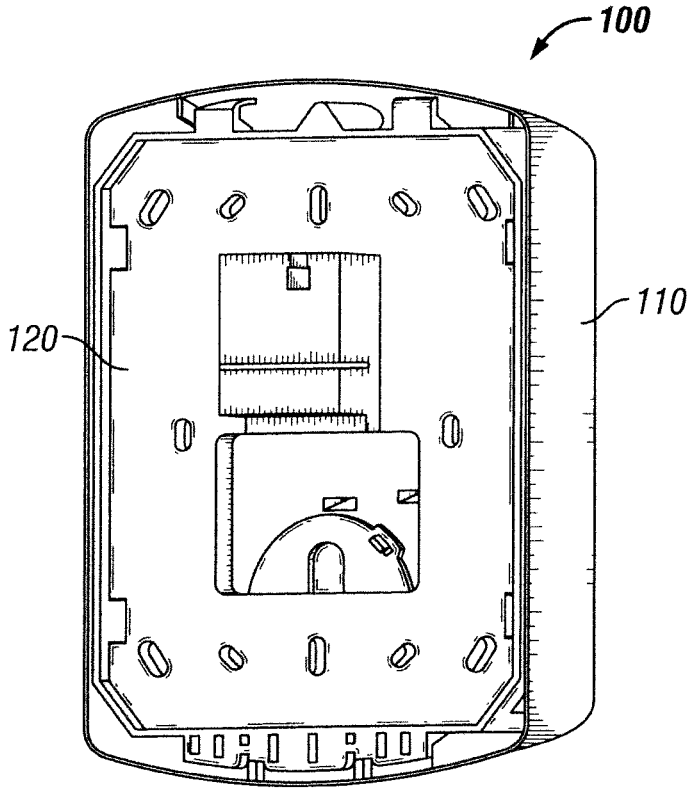
FIG. 1*d* is a rear perspective view of a notification device according to an exemplary embodiment.

The present invention may be better understood by reading the following description of non-limitative embodiments with reference to the attached drawings wherein like parts of each of the several figures are identified by the same reference characters.

The notification device described herein can be adapted for operation under any one or combination of standards, such as UL 1971, and can be installed in different locations, such as a corridor, a sleeping room, or a non-sleeping room. Although the exemplary embodiments describe a notification device configured for a wall, it is intended that the notification device can be used on a ceiling when UL 1971 light distribution is not required.

Referring to FIGS. 1*a* to 1*d*, a notification device 100 for wall installation is shown. Notification device 100 has a housing 110 that can be mounted using a mounting plate 120 to attach to a back box installed in a wall to provide any necessary electrical and mechanical connections. In this exemplary embodiment, housing 110 is shown to be rectangular, but housing 110 can have any shape, e.g., round. The mounting plate 120 can be secured to the rear side of the housing 110 and can be used to secure and/or remove the housing 110 to the back box in the wall. A lens 130 can cover the optical elements, such as a reflector unit 140 and a lamp (not shown in FIGS. 1*a* to 1*d*), and horn elements, such as a speaker or piezo 150. As shown in this exemplary embodiment, the lens 130 extends substantially across the face of the housing 120. Alternatively, the lens 130 can cover only the optical elements, such as the reflector unit 140 and the lamp. In an exemplary embodiment, the lens 130 can be made from a transparent polycarbonate. Alternatively, the lens can be transparent in only the area positioned over the optical elements, whereby the lens would still allow a complete light distribution pattern.

Figure 2A:
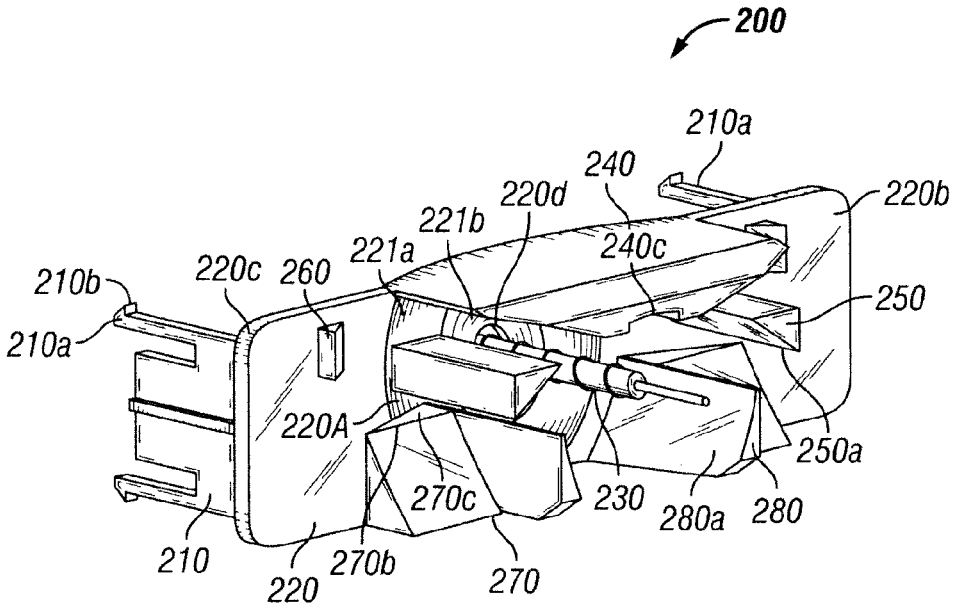
FIG. 2*a* is a perspective view of a reflector unit according to an exemplary embodiment.
Figure 2B:
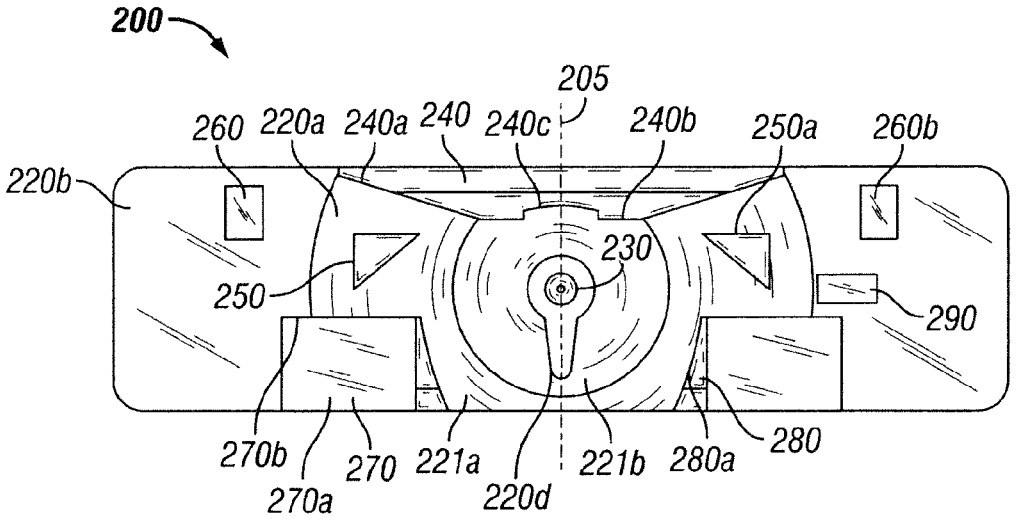
FIG. 2*b* is a frontal view of a reflector unit according to an exemplary embodiment.
Figure 2C:
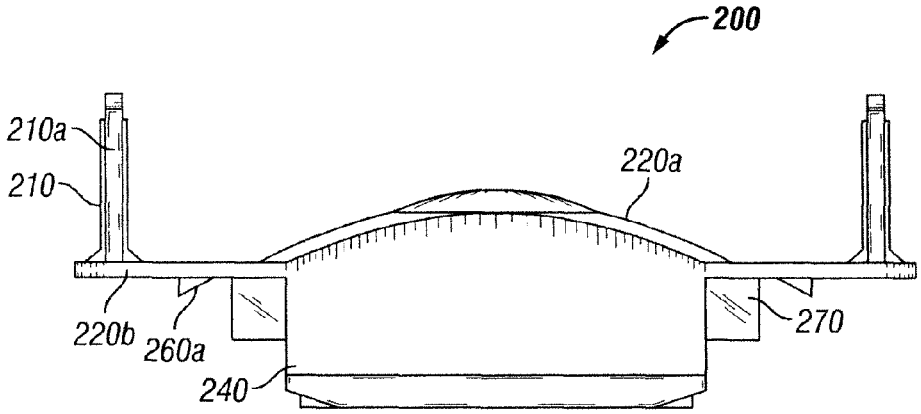
FIG. 2*c* is a top view of a reflector unit according to an exemplary embodiment.
Figure 2D:
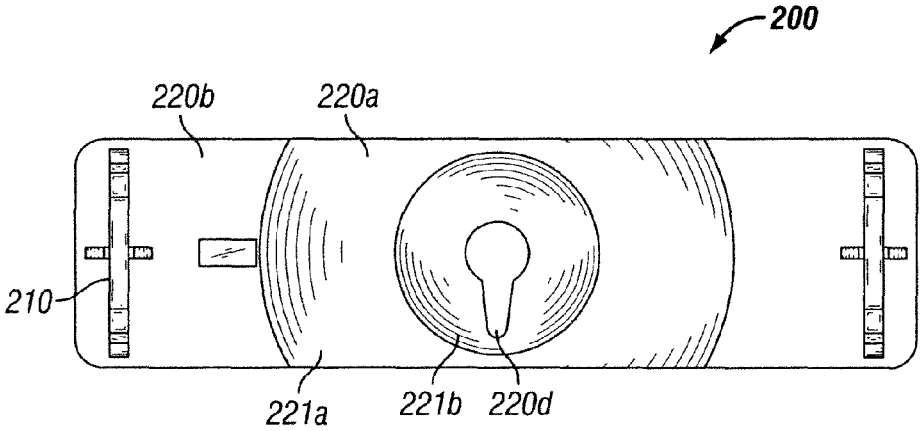
FIG. 2*d* is a rear view of a reflector unit according to an exemplary embodiment.

Lettering or a graphic, such as "FIRE" 160 can be printed on the device 100. The lens 130 can cover the FIRE 160 to protect it from tampering. When using a lens that is colored or translucent, however, it may be desirable to locate the FIRE 160 outside of the lens 130. The housing 110 can also include a light intensity selector, which can be adjusted from the rear of the device 100, that has a window for viewing the selected intensity of the lamp in candela units. In order to prevent tampering, the candela intensity window (shown as window 290 in FIG. 2*b*) can also be placed under the lens 130. This lens configuration allows flexibility in locating the candela window within the lens perimeter to provide protection and good visibility, though the candela window can also be located on the housing outside of the lens perimeter. Near the piezo 150, the lens 130 has a series of apertures that align with the openings in the fascia for the piezo 150. In one embodiment, the lens 130 can wrap around each of the slot shown for piezo 150. As a result, sound from the piezo 150 is not distorted, inhibited, or obstructed by the lens 130. Although the lens 130 can be configured to entirely cover the piezo 150, it can be desirable to not cover the piezo 150 to allow for better sound distribution.

Figure 3A:
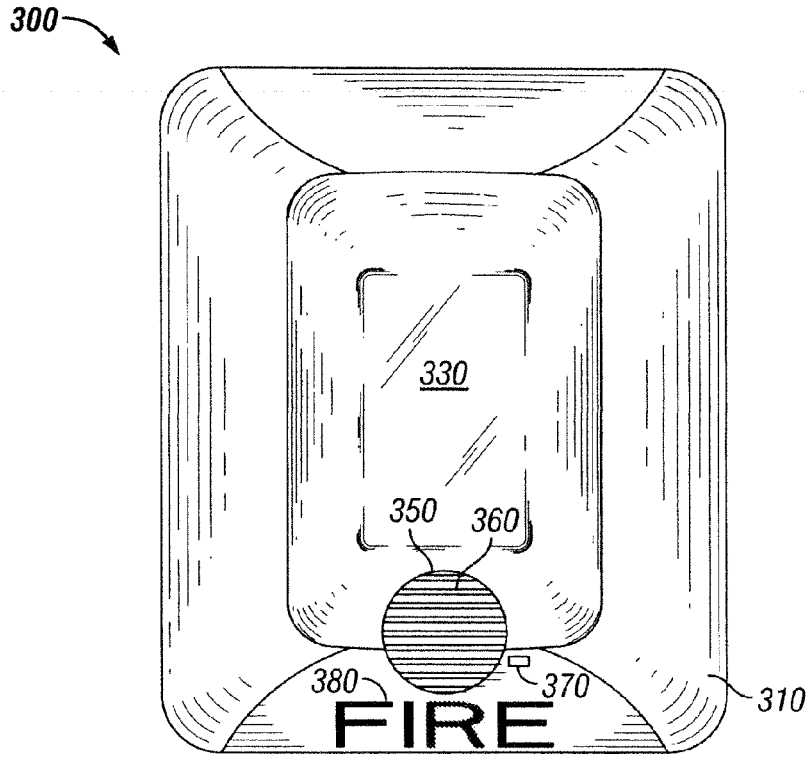
FIG. 3*a* shows a frontal view of a notification device according to an exemplary embodiment.
Figure 3B:
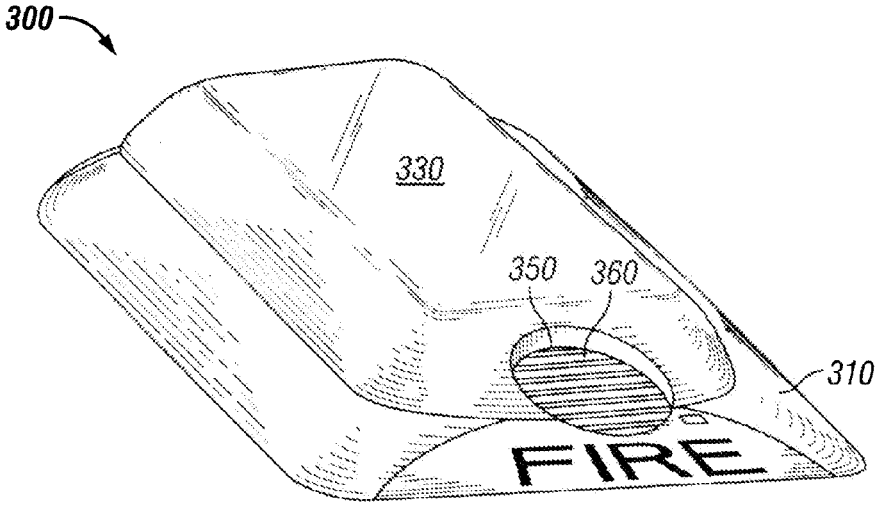
FIG. 3*b* shows a perspective view of a notification device according to an exemplary embodiment.
Figure 3C:
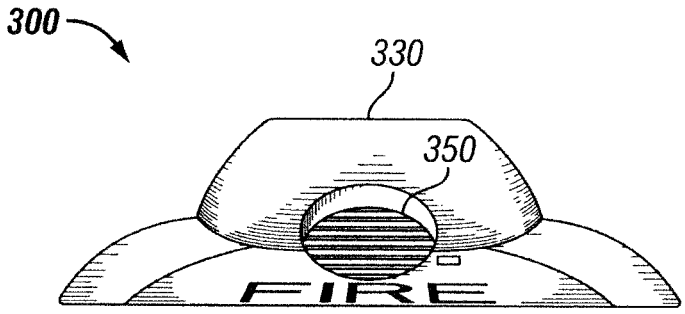
FIG. 3*c* shows a side view of a notification device according to an exemplary embodiment.

Alternatively, the lens can cover only the optical elements. Referring to FIGS. 3*a* to 3*c*, a notification device 300 is shown having a housing 310 and a lens 330. The lens 330 is substantially rectangular-shaped with a curved surface configured to cover the optical elements, such as the reflector unit 340. A horn element, such as piezo 350, is not covered by the lens 330. Instead, the piezo can be positioned behind louvers 360. The louvers 360 are a plurality of narrow slots that can optionally be adjustable. In the particular embodiment shown, the piezo 350 is a circular shape and overlaps with the substantially rectangular-shaped lens 330. As a result, the lens 330 can be configured to extend around, but not over, the piezo 350. In the particular embodiment shown, a candela window 370 is shown on the housing 310 outside of the lens 330. Also, lettering for FIRE 380 is shown as printed on the housing outside of the lens 330, though the lettering 380 can alternatively be printed under the lens 330.

Figure 4A:
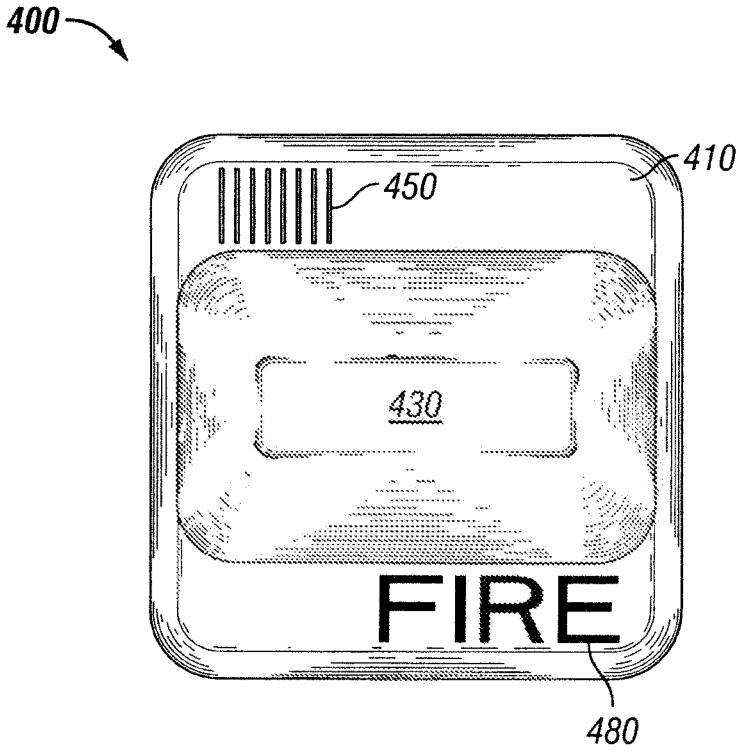
FIG. 4*a* shows a frontal view of a notification device according to an exemplary embodiment.
Figure 4B:
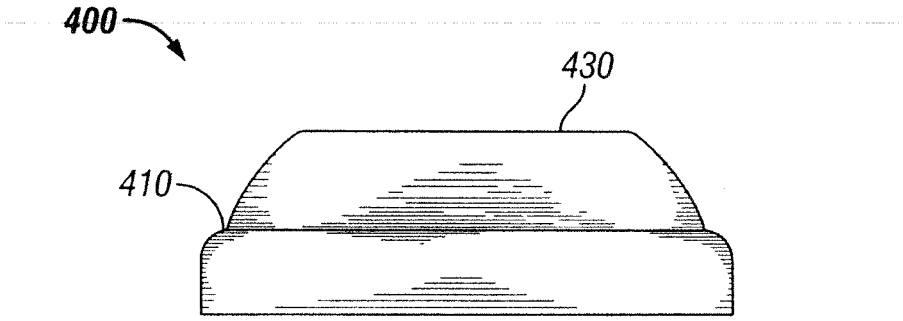
FIG. 4*b* shows a side view of a notification device according to an exemplary embodiment.
Figure 4C:
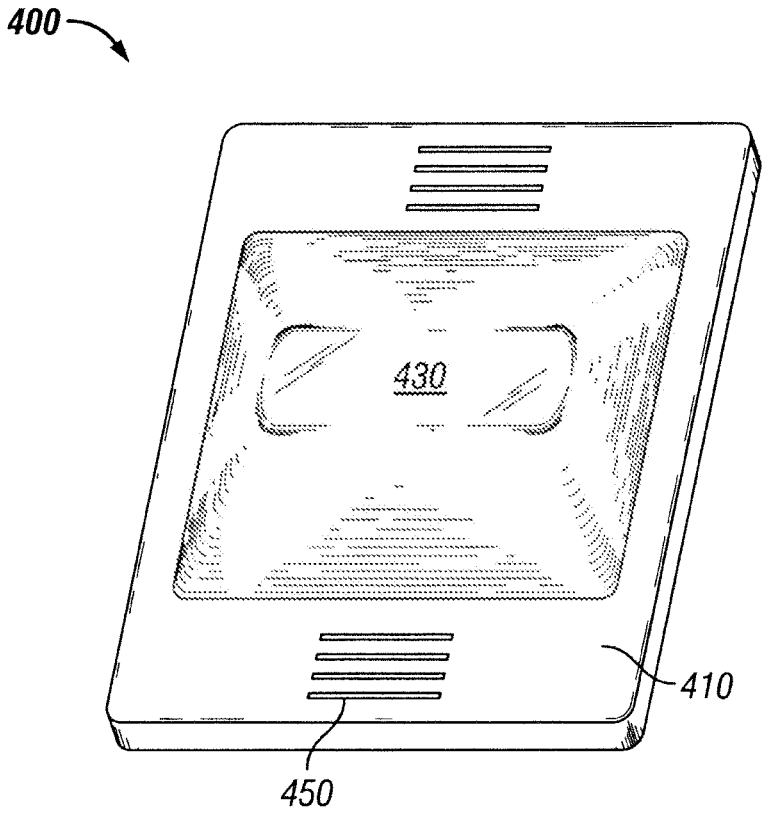
FIG. 4*c* shows a perspective view of a notification device according to an alternative exemplary embodiment.

In another alternative embodiment, as shown in FIGS. 4*a* to 4*c*, a lens 430 can extend over the optical elements in a notification device 400. The lens 430 can be substantially dome-shaped to cover the optical elements. The notification device 400 can include a piezo 450 positioned on a housing 410 outside of the lens 430. In this exemplary embodiment, lettering for FIRE 480 is shown as printed on the housing 410. As shown in FIG. 4*c*, the piezo 450 can be positioned at various locations on the housing 410.

In an exemplary embodiment, the lens can be made from a polycarbonate material for improved mechanical protection and flame retardant characteristics. The lens can be made of a transparent or opaque material. The lens can also have a color or hue, such as red, green blue, amber, or clear. In another embodiment, the lens can be transparent in only the area positioned over the optical elements, whereby the lens would still allow a complete light distribution pattern.

A reflector unit is installed in the housing and protected by the lens. In the exemplary embodiment described herein, the reflector is symmetrical about a central axis that extends from the bottom of the reflect unit to the top of the reflector unit, though it is intended that the configuration can be adapted to other configurations, such as where the reflector unit is not symmetrical. The reflector unit can be manufactured using a vacuum metalized injection-molded polycarbonate with UV resistant and scratch resistant lacquer. In one exemplary embodiment, the reflector unit can be approximately 85% reflective.

Referring to FIGS. 2*a* to 2*d*, a reflector unit 200 is shown. Reflector unit 200 is substantially symmetrical about a vertical axis 205. Reflector unit 200 has two tabs 210, each having two flanges 210*a* extending from the tab 210. The flanges 210*a* also include a lip 210*b*. The flanges 210*a* can be compressed to allow the insertion of the tab 210 into a recess in the printed circuit board. Once the tab 210 is inserted, the flanges 210*a* can expand and the lip 210*b* can assist in securing the reflector unit 200 by preventing printed circuit board form releasing the tabs 210.

The reflector unit 200 has a base 220. The base 220 has a continuously smooth, specular surface that is designed to reflect a significant portion of direct light from a lamp to illuminate both the vertical and horizontal planes. The base 220 has a curved base portion 220*a* and a flat base portion 220*b*. The curved base portion 220*a* is a substantially parabolic or freeform curvature shape that is symmetric about a central axis extending through the reflector unit, wherein the central axis is perpendicular to the plane of the wall. The curved base portion 220*a* can have two different contoured portions, shown as an upper portion 221*a* and a lower portion 221*b*, each having a different curvature. The lower portion 221*b* forms a cavity that directs light from the lamp to its nadir in the center of the reflector unit. The cavity can also double the intensity of the illumination effect on both horizontal and vertical planes. The flat base portion 220*b* extends from the left and right sides of the curved base portion 220*a*. The base 220 can be installed in a housing whereby the edge 220*c* aligns with an exposed surface of the housing.

A lamp 230 is positioned in the center of the base 220 through a keyhole 220*d* and extends in a direction along a central axis perpendicular to the plane of the wall. As shown in this exemplary embodiment, lamp 230 is a vertical flash tube that can be rated at 2.5 J. The lamp 230 can be a Xenon flashtube or any other suitable light source.

An upper reflective flange 240 extends from the base 220 in a direction away from the wall having a length substantially the same as the lamp 230. The width of upper reflective flange 240 is approximately the width of an outer edge of the curved base portion 220*a* substantially near the top of the reflector unit 200. The upper reflective flange 240 has sides 240*a* that taper toward the lamp 230. In the proximity of the lower portion 221*b*, the upper reflective flange 240 has a side 240*b* that is substantially parallel to the plane of the ceiling and floor. Between a first side 240*b* and a second side 240*b*, the upper reflective flange 240 has a recess 240*c* that has a width approximately the same as the widest diameter of the keyhole 220*d*. The surfaces of upper reflective flange 240 are continuously smooth and can reflect a significant portion of direct light from the lamp 230 to illuminate the horizontal and vertical planes. More specifically, side 240*a* can reflect light in a horizontal plane, whereas sides 240*c* can reflect light in a vertical plane, and sides 240*b* can reflect light in between horizontal and vertical planes at about 45 degrees.

A first and second specular protrusion 250 extend from the upper portion 221*a*. The specular protrusion 250 has a surface 250*a* substantially facing the a lower edge of the base 220 near the lowest point of the lower portion 221*b* of the curved base portion 220*a*. The specular protrusion 250 can reflect direct light from the lamp 230 to illuminate the vertical plane.

A first and second specular wedge 260 extend from an upper portion of the flat base portion 220*b*. The specular wedge 260 has a surface 260*a* that tapers to an edge 260*b* closest to the lamp 230. Light can travel from the lamp 230 to side 240*a*, which is then reflected to the specular wedge 260, which can reflect the light to the horizontal plane to compensate illumination in the specified area.

A third and fourth specular protrusion 270 extend from a lower portion of the base 220 on each side of the lamp 230. The specular protrusion 270 has a surface 270*a* that tapers to an edge 270*b* proximate to the base 220. In this embodiment, the edge 270*b* is aligned with the plane of the flat base portion 220*b* and is not curved along with the curved base portion 220*a*, thereby forming surface 270*c*. As shown in the exemplary embodiment, the specular protrusion 270 extends from both the curved base portion 220*a* and the flat base portion 220*b*. The specular protrusion 270 acts as a secondary reflector to reflect light reflected by the specular protrusion 250 to compensate illumination in a specified area in the vertical plane.

A fifth and sixth specular protrusion 280 extend from a lower portion of the base 220 on each side of the lamp 230 and abut the specular protrusion 270. The specular protrusion 280 extends in a direction along a plane perpendicular to the wall and extends further than the specular protrusion 270, but has a height of approximately the height of the specular protrusion 270. The specular protrusion 280 has a curved surface 280*a* that substantially faces the lamp 230. The specular protrusion 280 can reflect light to illuminate the horizontal plane.

When the lamp 230 is illuminated, the light from the lamp 230 reflects off the reflective surface described above and into the vertical and horizontal planes. As a result, the notification device can achieve the polar light distribution pattern required by UL 1971.

The notification device incorporating this reflector has a greater optical efficiency than a conventional strobe having a 185 candela output. The efficiency allows for a reduction in power needed to operate the lamp. This reduction in lamp wattage translates into a lower current rating for the appliance. While a conventional 185 candela strobe may need to expend as much as 4.5 J of electrical energy for the strobe to meet the UL 1971 requirements for 135 candela and 185 candela settings, the notification device described herein can achieve the UL 1971 standard with only 2.5 J of energy expended by the flashtube at both 135 candela and 185 candela, which is almost a doubling in optical efficiency. Rather than using two separate models of notification devices for low candela (e.g., 15, 30, 75, and 110 candela) and high candela (e.g., 135 and 185 candela), a single notification device described herein can be used in all wall applications from about 15 to 185 candela output. For example, the notification device can be set via a switch to 15, 15/75, 30, 75, 95, 110, 135, and 185 candela. The 15/75 candela setting delivers 75 candela light output on axis and provides a 15 candela light distribution.

Because the notification device allows for a lower energy flash-tube, high and low intensity strobes can use the same lower energy flash tube and can therefore be combined into one unit. This reduces cost as the lower energy tube is not as expensive as the higher energy one and it also reduces the number of product models or variations, i.e., Stock Keeping Units ("SKU") reduction. As a result, customers only need to purchase one type of notification device, eliminating any confusion or mistaken purchases of the wrong device. Also, managing one model is easier for distribution and stocking purposes.

Although the exemplary embodiment recites a 185 candela output, it is intended that the reflector unit can be configured for other candela outputs, such as 110 candela. The light output can be adjusted electrically by lowering or raising the energy to the lamp from about 0.6 J to about 2.5 J. The configuration of the reflector unit can be adjusted to affect the amount of reflected light from the lamp, such as reducing the size of the base for a lower light distribution, reconfiguring the base to accommodate a larger lamp, or increasing or decreasing the surface area of any component, such as by varying the size of the upper and/or lower portions of the base.

Therefore, the present invention is well adapted to attain the ends and advantages mentioned as well as those that are inherent therein. The particular embodiments disclosed above are illustrative only, as the present invention may be modified and practiced in different but equivalent manners apparent to those having ordinary skill in the art having the benefit of the teachings herein. While numerous changes may be made by those having ordinary skill in the art, such changes are encompassed within the spirit and scope of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention as defined by the claims below. The terms in the claims have their plain, ordinary meaning unless otherwise explicitly and clearly defined by the patentee.

What is claimed is:

1. A notification device comprising:

a housing; and a reflector unit mounted to the housing, the reflector unit comprising:

a base, wherein the housing is disposed around an outer perimeter of the base, wherein the base comprises:

a curved portion; and a reflective flat portion extending from the curved portion on a first side of a vertical axis and a second side of the vertical axis, wherein the reflective flat portion surrounds at least a portion of an outer perimeter of the curved portion; and a first specular protrusion and a second specular protrusion that extend from within a curved interior surface of the curved portion of the base, wherein the first specular protrusion and the second specular protrusion are positioned on the curved surface of the curved portion away from the outer perimeter of the curved portion, wherein a surface of the first specular protrusion and a surface of the second specular protrusion are substantially directed toward a lower edge of the base near the vertical axis, wherein the surface of the first specular protrusion and the surface of the second specular protrusion extend from the curved surface of the curved portion in a substantially orthogonal direction relative to a front surface of the reflective flat portion.

2. The notification device of claim 1, wherein the curved portion of the base comprises an upper portion and a lower portion, wherein the upper portion and the lower portion each have a different curvature, and wherein the upper portion is proximate to the reflective flat portion of the base.

3. The notification device of claim 2, wherein the lower portion comprises a keyhole for receiving a light source.

4. The notification device of claim 1, further comprising:

a third specular protrusion extending from the base and positioned on the first side of the vertical axis; and a fourth specular protrusion extending from the base and positioned on the second side of the vertical axis;

wherein each of the third specular protrusion and the fourth specular protrusion tapers in a direction parallel to the vertical axis.

5. The notification device of claim 1, further comprising a light source.

6. The notification device of claim 1, further comprising a reflective flange extending from a location near a top edge of the base, the reflective flange having a lower surface that tapers from the vertical axis toward the top side of the base.

7. The notification device of claim 6, wherein the lower surface of the reflective flange comprises a recess positioned at the vertical axis.

8. The notification device of claim 7, wherein the lower surface further comprises:

a first surface portion extending from the recess on the first side of the vertical axis and substantially perpendicular to the vertical axis; and a second surface portion extending from the recess on the second side of the vertical axis and substantially perpendicular to the vertical axis.

9. The notification device of claim 1, further comprising a lens coupled to the housing and disposed over at least a portion of the reflector unit, wherein the lens extends to a perimeter of the housing.

10. The notification device of claim 1, further comprising a lens and a horn element, wherein the lens is coupled to the housing and disposed over at least a portion of the reflector unit and wherein the lens has at least one aperture positioned substantially over the horn element.

11. The notification device of claim 1, further comprising a horn element, wherein the horn element is positioned behind a plurality of louvers.

12. A reflector unit comprising:

a base comprising:

a curved portion centered on a vertical axis; and a flat portion extending from the curved portion on a first side of the vertical axis and a second side of the vertical axis, wherein the flat portion surrounds at least a portion of an outer perimeter of the curved portion;

a first specular protrusion and a second specular protrusion that extend from within a curved interior surface of the curved portion of the base in a substantially orthogonal direction relative to a front surface of the flat portion, wherein the first specular protrusion and the second specular protrusion are positioned on the curved interior surface of the curved portion away from the outer perimeter of the curved portion; and a third specular protrusion and a fourth specular protrusion extending from the flat portion and from the curved interior surface of the curved portion, wherein the third specular protrusion is positioned on the first side of the vertical axis and the fourth specular protrusion is positioned on the second side of the vertical axis, the third specular protrusion and the fourth specular protrusion each extending from a lower outer edge of the base and tapering in a direction parallel to the vertical axis, wherein a surface of the third specular protrusion is oriented to reflect light reflected by the first protrusion and wherein a surface of the fourth specular protrusion is oriented to reflect light reflected by the second protrusion.

13. The reflector unit of claim 12, wherein the first specular protrusion and the second specular protrusion are wedge-shaped, each of the first specular protrusion and the second specular protrusion having a triangular side that is substantially parallel to the front surface of the flat portion, the first specular protrusion and the second specular protrusion each comprising a surface substantially directed toward the lower outer edge of the base near the vertical axis.

14. The reflector unit of claim 12, wherein the curved portion of the base comprises:

an upper portion positioned proximate to the flat portion of the base; and a lower portion, wherein the upper portion and the lower portion each have a different curvature.

15. The reflector unit of claim 14, wherein the lower portion comprises a keyhole for receiving a lamp.

16. The reflector unit of claim 12, wherein each of the third and fourth specular protrusions has a first portion extending from the flat portion of the base and a second portion extending from the curved portion of the base.

17. The reflector unit of claim 12, a reflective flange extending from a location near a top edge of the base and along a plane perpendicular to the flat portion, the reflective flange having a lower surface that tapers from the vertical axis toward the top side of the base.

18. A notification device, comprising:

a housing;

a reflector unit mounted to the housing, the reflector unit comprising:

a base comprising:

a curved portion; and a flat portion extending from the curved portion on a first side of a vertical axis and a second side of the vertical axis, wherein the flat portion surrounds at least a portion of an outer perimeter of the curved portion;

a first specular protrusion and a second specular protrusion that extend from within a curved interior surface of the curved portion of the base in a substantially orthogonal direction relative to a front surface of the flat portion, wherein the first specular protrusion and the second specular protrusion are positioned on the curved interior surface of the curved portion away from the outer perimeter of the curved portion; and a third specular protrusion and a fourth specular protrusion extending from the flat portion of the base and from the curved interior surface of the curved portion of the base, wherein the third specular protrusion is positioned on the first side of the vertical axis and the fourth specular protrusion is positioned on the second side of the vertical axis, and wherein the third specular protrusion and the fourth specular protrusion each taper toward the vertical axis, wherein a surface of the third specular protrusion is oriented to reflect light reflected by the first protrusion and wherein a surface of the fourth specular protrusion is oriented to reflect light reflected by the second protrusion; and a lens positioned over at least a portion of the reflector unit.

19. The notification device of claim 18, wherein the first specular protrusion and the second specular protrusion are wedge-shaped, each of the first specular protrusion and the second specular protrusion having a triangular side that is substantially parallel to the front surface of the flat portion.

20. The notification device of claim 18, further comprising a reflective flange extending from a location near a top side of the base, the reflective flange having a lower surface that tapers from the vertical axis toward the top side of the base.

* * * * *